US007393157B1

(12) United States Patent
Macias

(10) Patent No.: US 7,393,157 B1
(45) Date of Patent: Jul. 1, 2008

(54) TIMBER PILE PROTECTION APPARATUS AND METHOD

(76) Inventor: Richard A. Macias, 13490 Altamar Cir., Corona, CA (US) 92883

( * ) Notice: Subject to any disclaimer, the term of this patent is extended or adjusted under 35 U.S.C. 154(b) by 118 days.

(21) Appl. No.: 11/461,954

(22) Filed: Aug. 2, 2006

(51) Int. Cl.
*E02D 5/60* (2006.01)

(52) U.S. Cl. ..... 405/216; 405/211; 52/170; 52/736.4

(58) Field of Classification Search ..... 405/211, 405/216; 52/170, 736.4
See application file for complete search history.

(56) References Cited

U.S. PATENT DOCUMENTS 3,141,306 A * 7/1964 Liddell ..... 405/216
4,743,142 A 5/1988 Shiraishi et al.
4,764,054 A * 8/1988 Sutton ..... 405/216
4,921,555 A * 5/1990 Skiff ..... 405/216
5,138,806 A 8/1992 Marx et al.
5,516,236 A 5/1996 Williams et al.
5,586,838 A 12/1996 Walsh
5,816,746 A 10/1998 Blair
5,829,920 A * 11/1998 Christenson ..... 405/216
5,919,004 A * 7/1999 Christenson ..... 405/216
6,019,549 A 2/2000 Blair et al.

* cited by examiner

*Primary Examiner*—Frederick L. Lagman

(57) ABSTRACT

A timber pile protection apparatus includes a sleeve that has an open first end, an open second end and a peripheral wall extending between the first and second ends. The sleeve is positioned on the timber pile. The first end is positioned nearer to a bottom end than a top end of the timber pile. The sleeve is positionable in an unrolled position extending upwardly from the first end or in a rolled position rolled downwardly to the first end. A tether has an attached end and a free end. The attached end is attached to the sleeve adjacent to the second end of the sleeve. The tether has a length greater than the sleeve. The free end extends outwardly from the sleeve when the sleeve is in the rolled position and is graspable to be pulled upwardly and unroll the sleeve to the unrolled position.

7 Claims, 5 Drawing Sheets

TIMBER PILE PROTECTION APPARATUS AND METHOD

BACKGROUND OF THE INVENTION

1. Field of the Invention

The present invention relates to timber pile protecting devices and more particularly pertains to a new timber pile protecting device for protecting a timber pile from water damage and to prevent organisms from attaching to and growing on the timber pile.

2. Description of the Prior Art

The use of timber pile protecting devices is known in the prior art. While these devices fulfill their respective, particular objectives and requirements, the need remains for a device that may be positioned on a timber pile to protect the timber pile and which can be easily maneuvered into a position covering the timber pile without the need of divers to go under water and cover the timber pile.

SUMMARY OF THE INVENTION

The present invention meets the needs presented above by generally comprising a sleeve that has an open first end, an open second end and a peripheral wall extending between the first and second ends. The sleeve is positioned on the timber pile. The first end is positioned nearer to a bottom end than a top end of the timber pile. The sleeve is positionable in an unrolled position extending upwardly from the first end or in a rolled position rolled downwardly to the first end. The sleeve is comprised of a water impermeable material. At least one tether has an attached end and a free end. The attached end is attached to the sleeve adjacent to the second end of the sleeve. The at least one tether has a length greater than the sleeve. The free end extends outwardly from the sleeve when the sleeve is in the rolled position and is graspable to be pulled upwardly and unroll the sleeve to the unrolled position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
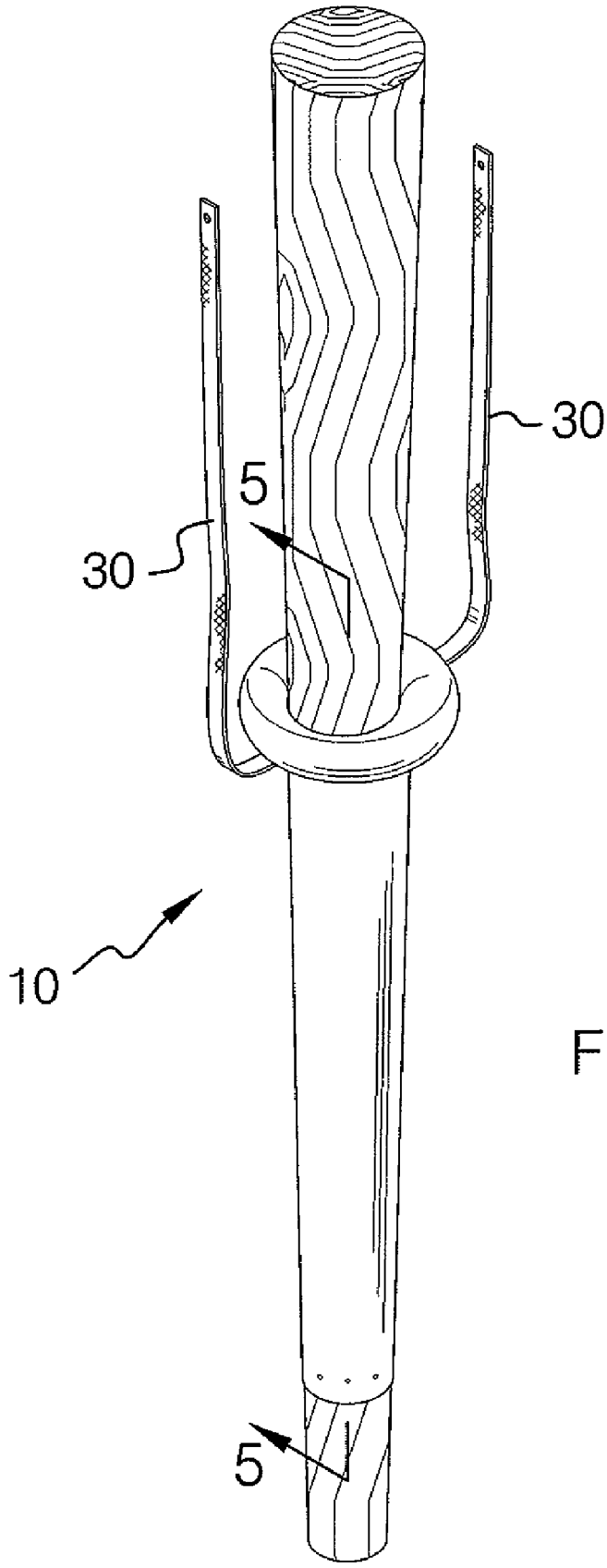
FIG. 1 is a perspective view of a timber pile protection apparatus and method according to the present invention.

With reference now to the drawings, and in particular to FIGS. 1 through 5 thereof, a new timber pile protecting device embodying the principles and concepts of the present invention and generally designated by the reference numeral 10 will be described.

Figure 2:
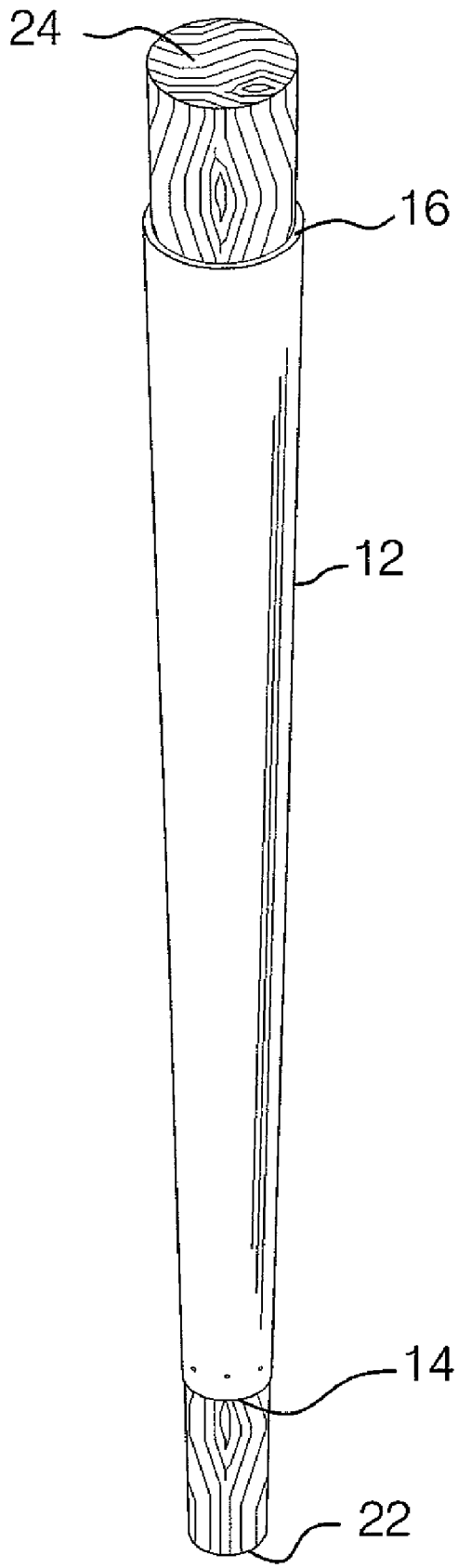
FIG. 2 is a perspective view of the present invention.
Figure 3:
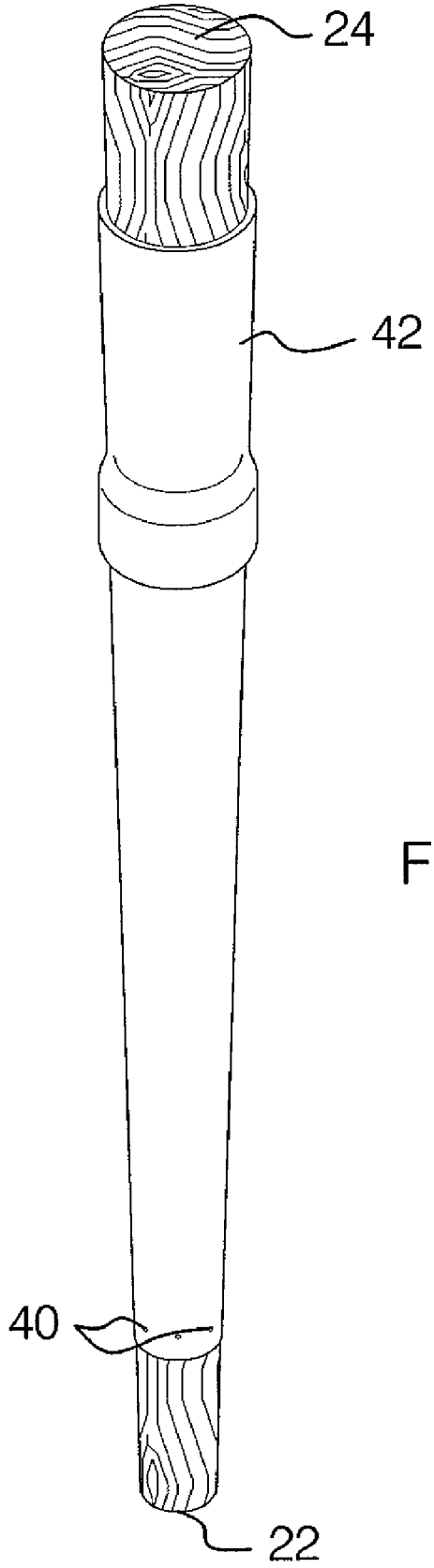
FIG. 3 is a perspective view of the present invention and including a sheath.
Figure 4:
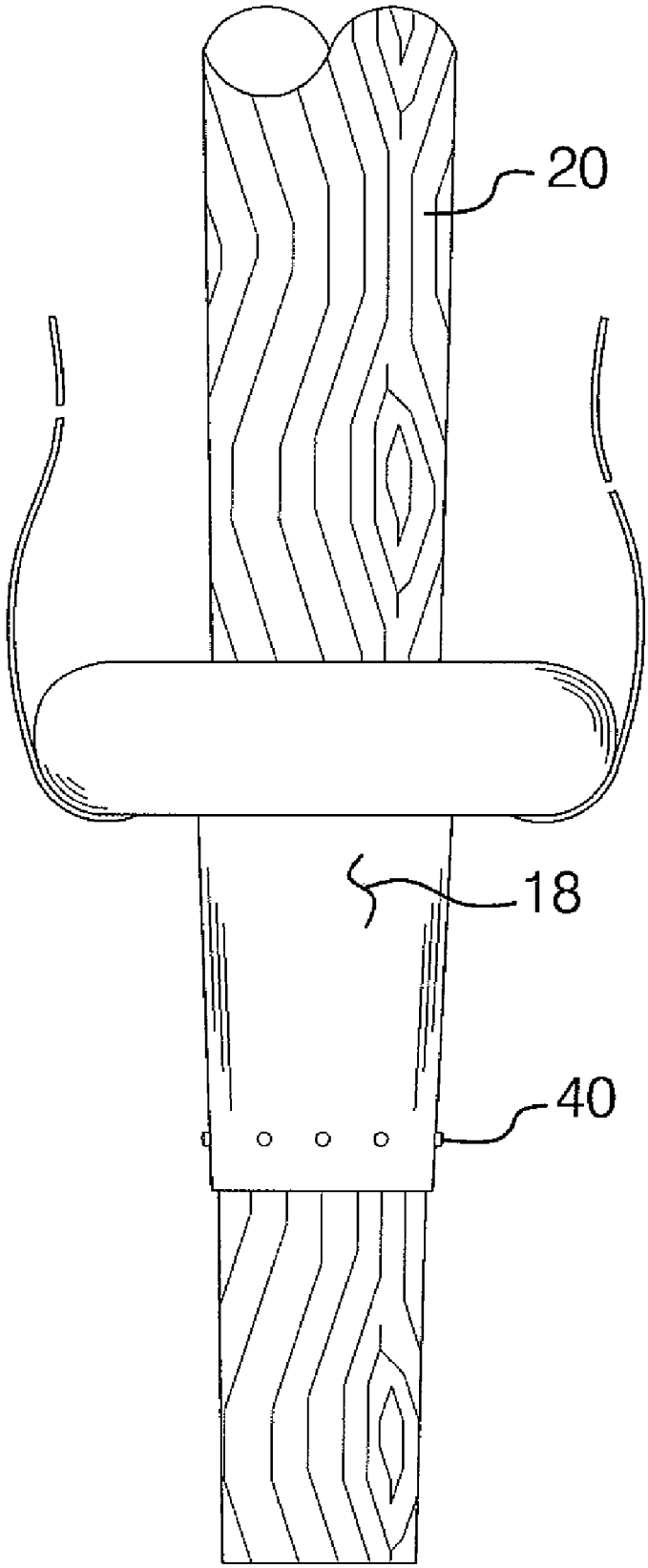
FIG. 4 is a side view of the present invention in a rolled up configuration.
Figure 5:
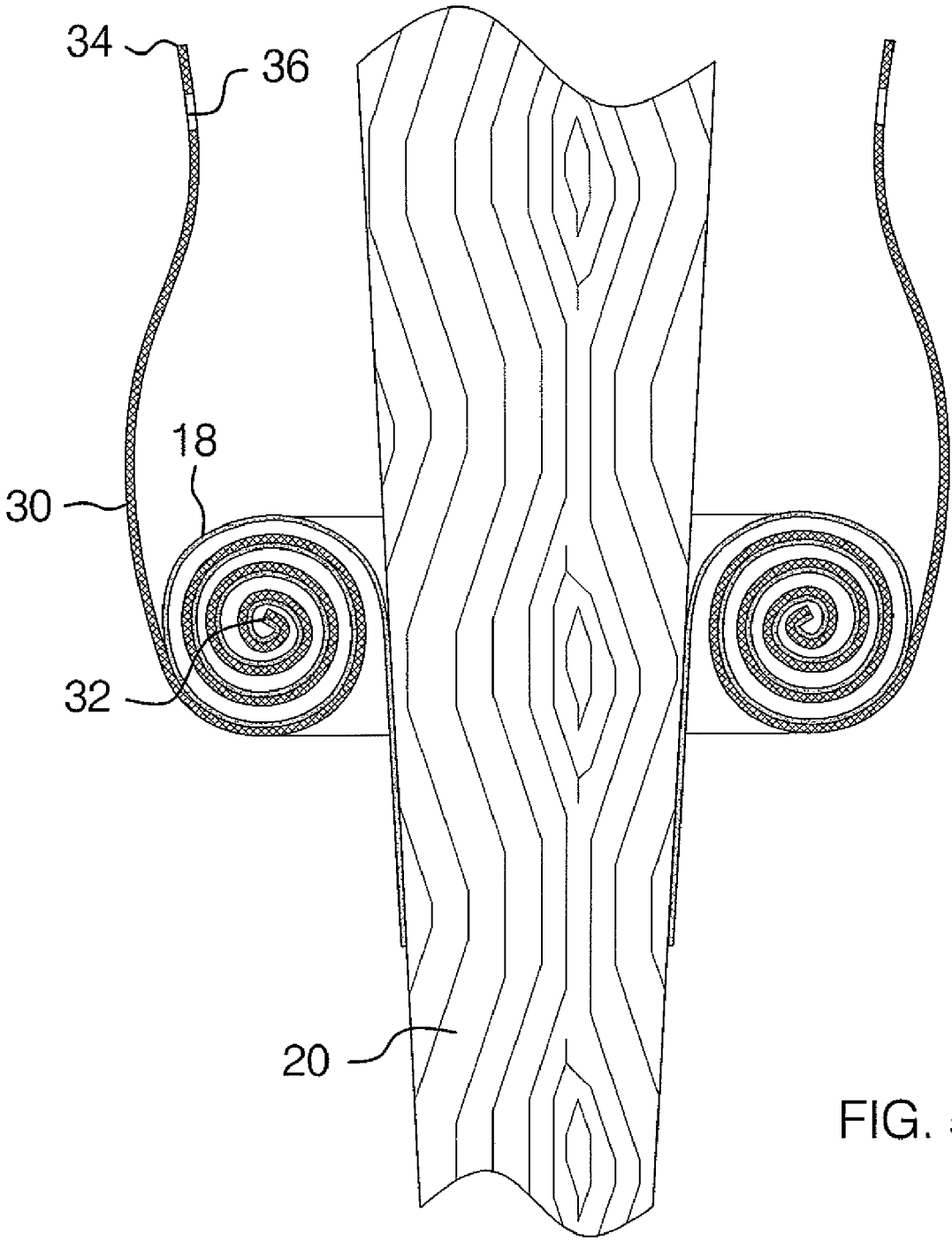
FIG. 5 is side a cross-sectional view of the present invention in the rolled up configuration.

As best illustrated in FIGS. 1 through 5, the timber pile protection apparatus and method 10 providing a sleeve 12 that has an open first end 14, an open second end 16 and a peripheral wall 18 extending between the first 14 and second 16 ends. The sleeve 12 is positioned on a timber pile 20. The first end 14 is positioned nearer to a bottom end 22 than a top end 24 of the timber pile 20 and adjacent to a mud line of the timber pile 20 once the timber pile 20 is extended into a bed of a body of water. The sleeve 12 is positionable in an unrolled position extending upwardly from the first end 14, as shown in FIG. 2, or in a rolled position rolled downwardly to the first end 14, as shown in FIG. 4. The sleeve 12 is comprised of a water impermeable material and has a length configured to position the second end 16 approximately adjacent to a high tide water line of the timber pile 20.

A pair of tethers 30 is provided and each has an attached end 32 and a free end 34. Each of the attached ends 32 is attached to the sleeve 12 adjacent to the second end 16 of the sleeve 12. The tethers 30 have a length greater than the sleeve 12. This allows the free ends to extend outwardly from the sleeve 12 when the sleeve 12 is in the rolled position. The tethers 30 each have apertures 36 therein positioned adjacent to the free ends 34 for securing the tethers 30 when the sleeve 12 is in the unrolled position.

Once the sleeve 12, in a rolled up position, is placed on the timber pile 20, pulling the tethers 30 upwardly toward the top end 24 of the timber pile 20 unrolls the sleeve 12. This provides a relatively simple and easy method of covering the timber pile. Once the sleeve 12 is unrolled, the tethers 30 may be removed. The sleeve 12, in its rolled up configuration, may be positioned on the timber pile 20 at an appropriate distance from the bottom end 22 before the bottom end 22 is driven into a bed of a body of water. Once covered with the sleeve 12, the timber pile 20 is protected from water damage.

Fasteners 40 may be provided and extended into the sleeve 12 and into the timber pile 20 adjacent to the first end 14 of the sleeve 12 to prevent the sleeve 12 from rolling upwardly from the first end 14 and to hold the first end 14 of the sleeve 12 in place.

A tubular sheath 42 may be provided which is extended over the second end 16 of the sleeve 12 when the sleeve 12 is in the unrolled position to secure the second end 16 in place.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A timber pile protection assembly for protecting a timber pile from water, said protection assembly comprising:

a sleeve having an open first end, an open second end and a peripheral wall extending between said first and second ends, said sleeve being positioned on the timber pile, said first end being positioned nearer to a bottom end than a top end of said timber pile, said sleeve being positionable in an unrolled position extending upwardly from said first end or in a rolled position rolled downwardly to said first end, said sleeve being comprised of a water impermeable material; and at least one tether having an attached end and a free end, said attached end being attached to said sleeve adjacent to said second end of said sleeve, said at least one tether having a length greater than said sleeve, said free end extending outwardly from said sleeve when said sleeve is in said rolled position, said at least one tether being graspable to be pulled upwardly and unroll said sleeve to said unrolled position.

2. The assembly according to claim 1, further including a plurality of fasteners, each of said fasteners extending into said sleeve and into the timber pile to secure said sleeve to said timber pile, said fasteners being positioned adjacent to said first end of said sleeve.

3. The assembly according to claim 1, further including a tubular sheath being extended over said second of said sleeve when said sleeve is in said unrolled position.

4. A timber pile protection assembly for protecting a timber pile from water, said protection assembly comprising:

a sleeve having an open first end, an open second end and a peripheral wall extending between said first and second ends, said sleeve being positioned on the timber pile, said first end being positioned nearer to a bottom end than a top end of said timber pile, said sleeve being positionable in an unrolled position extending upwardly from said first end or in a rolled position rolled downwardly to said first end, said sleeve being comprised of a water impermeable material;

a pair of tethers each having an attached end and a free end, each of said attached ends being attached to said sleeve adjacent to said second end of said sleeve, said tethers having a length greater than said sleeve, said free ends extending outwardly from said sleeve when said sleeve is in said rolled position, said tethers being graspable to be pulled upwardly and unroll said sleeve to said unrolled position;

a plurality of fasteners, each of said fasteners extending into said sleeve and into the timber pile to secure said sleeve to said timber pile, said fasteners being positioned adjacent to said first end of said sleeve; and a tubular sheath being extended over said second of said sleeve when said sleeve is in said unrolled position.

5. A method of protecting a timber pile, said method comprising the steps of:

providing a sleeve having an open first end, an open second end and a peripheral wall extending between said first and second ends, said sleeve being positioned on the timber pile, said first end being positioned nearer to a bottom end than a top end of said timber pile and adjacent to a mud line of the timber pile, said sleeve being positionable in an unrolled position extending upwardly from said first end or in a rolled position rolled downwardly to said first end, said sleeve being comprised of a water impermeable material, said sleeve having a length configured to position said second end approximately adjacent to a high tide water line of the timber pile;

providing a pair of tethers each having an attached end and a free end, each of said attached ends being attached to said sleeve adjacent to said second end of said sleeve, said tethers having a length greater than said sleeve, said free ends extending outwardly from said sleeve when said sleeve is in said rolled position;

unrolling said sleeve by pulling said tethers upwardly toward the top end of the timber pile.

6. The method according to claim 5, further including the steps of providing a plurality of fasteners and extending each of said fasteners extending into said sleeve and into the timber pile adjacent to said first end of said sleeve.

7. The method according to claim 5, further including the step of providing a tubular sheath and extending said tubular sheath over said second of said sleeve when said sleeve is in said unrolled position.

* * * * *